US009614334B2

(12) United States Patent
Chen

(10) Patent No.: US 9,614,334 B2
(45) Date of Patent: Apr. 4, 2017

(54) HERMAPHRODITIC ELECTRICAL CONNECTOR

(71) Applicant: MICROSOFT TECHNOLOGY LICENSING, LLC, Redmond, WA (US)

(72) Inventor: Chong Chen, Beijing (CN)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 0 days.

(21) Appl. No.: 14/529,876

(22) Filed: Oct. 31, 2014

(65) Prior Publication Data

US 2016/0126685 A1 May 5, 2016

(30) Foreign Application Priority Data

Oct. 31, 2014 (CN) ..... 2014 1 0598313

(51) Int. Cl.
*H01R 25/00* (2006.01)
*H01R 24/84* (2011.01)
(Continued)

(52) U.S. Cl.
CPC ..... *H01R 24/84* (2013.01); *H01R 13/28* (2013.01); *H01R 43/20* (2013.01); *H01R 12/716* (2013.01); *H01R 13/245* (2013.01)

(58) Field of Classification Search
CPC ..... H01R 24/84; H01R 43/20; H01R 12/712; H01R 12/716; H01R 13/282; H01R 24/00; H01R 13/193
(Continued)

(56) References Cited

U.S. PATENT DOCUMENTS 4,533,200 A 8/1985 Wilson
4,975,062 A 12/1990 Evans et al.
(Continued)

OTHER PUBLICATIONS

"0.80 mm Razor Beam™ High Speed Hermaphroditic Terminal/Socket Strip", Published on: Jan. 27, 2013 Available at: http://www.samtec.com/technical-specifications/default.aspx?SeriesMaster=LSEM.
(Continued)

*Primary Examiner* — Jean F Duverne
(74) *Attorney, Agent, or Firm* — Qudus Olaniran; Judy Yee; Micky Minhas

(57) ABSTRACT

The subject matter described herein relates to a hermaphroditic electrical connector. Embodiments of the hermaphroditic electrical connector and a method of manufacturing the connector are provided. In one embodiment, The hermaphroditic electrical connector comprises an insulating body comprising at least one installation wall and a plurality of openings on the installation wall, and a plurality of conductive contactors, each being coupled to the body at the each of the plurality of openings and comprising at least a pair of a spring portion and a receiving portion, such that at least one of the spring portion and the receiving portion within the pair is configured to detachably connect to a separate electrical connector moving towards an inner surface of the installation wall, while the other of the spring portion and the receiving portion within the pair is configured to detachably connect to a separate electrical connector moving towards an outer surface of the installation wall opposite to the inner surface. The hermaphroditic electrical connector according to the present subject matter described herein may allow at least two of connectors with same structures being electrically connected in a self-aligned manner.

20 Claims, 8 Drawing Sheets

(51) Int. Cl.

| | |
|---|---|
| ***H01R 43/20*** | (2006.01) |
| ***H01R 13/28*** | (2006.01) |
| *H01R 12/71* | (2011.01) |
| *H01R 13/24* | (2006.01) |

(58) Field of Classification Search
USPC ..... 439/284
See application file for complete search history.

(56) References Cited

U.S. PATENT DOCUMENTS

| | | | | |
|---|---|---|---|---|
| 5,098,311 | A | 3/1992 | Roath et al. | |
| 5,498,167 | A | 3/1996 | Seto et al. | |
| 5,575,674 | A | 11/1996 | Davis et al. | |
| 5,577,928 | A | 11/1996 | Duclos | |
| 5,730,613 | A | 3/1998 | Yamada | |
| 5,768,777 | A | 6/1998 | Lemke | |
| 6,193,537 | B1 | 2/2001 | Harper et al. | |
| 6,257,901 | B1 * | 7/2001 | Torii | H01R 12/7082 439/74 |
| 6,692,311 | B1 * | 2/2004 | Kamei | H01R 9/2458 439/218 |
| 7,118,388 | B2 * | 10/2006 | Midorikawa | H01R 12/716 439/74 |
| 8,192,217 | B2 | 6/2012 | Zhu | |
| 8,764,470 | B2 * | 7/2014 | Little | H01R 12/716 439/284 |
| 2008/0194125 | A1 | 8/2008 | Dahms et al. | |
| 2010/0130042 | A1 * | 5/2010 | Gray | H01R 4/4818 439/176 |
| 2010/0167569 | A1 * | 7/2010 | Stoner | H01R 13/193 439/284 |
| 2013/0149908 | A1 | 6/2013 | Little et al. | |
| 2013/0260589 | A1 * | 10/2013 | Chen | H01R 12/712 439/284 |

OTHER PUBLICATIONS

"Board-to-Board Connector Features Scalable One-Piece Design", Published on: Dec. 19, 2011 Available at: http://news.thomasnet.com/fullstory/Board-to-Board-Connector-features-scalable-one-piece-design-607099.

"Self-Mating Hermaphroditic Strip", Jul. 30, 2014 Available at: https://www.samtec.com/ftppub/pdf/hlst.pdf.

"International Search Report and Written Opinion Issued in PCT Application No. PCT/US2015/058174", Mailed Date: Dec. 18, 2015, 13 Pages.

* cited by examiner

HERMAPHRODITIC ELECTRICAL CONNECTOR

RELATED APPLICATIONS

This application claims priority to Chinese Application No. 201410598313.1, filed on Oct. 31, 2014, and entitled "HERMAPHRODITIC ELECTRICAL CONNECTOR." This application claims the benefit of the above-identified application, and the disclosure of the above-identified application is hereby incorporated by reference in its entirety as if set forth herein in full.

BACKGROUND

Traditionally, a pair of male connector and female connector is needed for forming electrical connection between two boards. Such connection is used in many situations, for example, for conducting a signal or power transmission between two devices. As a result, in order to produce pairs of connectors, it needs two different manufacturing lines, which results in a cost increase.

Hermaphroditic connectors have been brought to the market for the purpose of solving this problem. A pair of hermaphroditic connectors include a pair of connectors built with same components and can be mated with each other to form electrical connection. Traditional solutions usually require careful alignment when the user intends to mate the two connectors together.

SUMMARY

Embodiments of the subject matter described herein generally relate to a hermaphroditic electrical connector used for forming board-to-board connection.

One embodiment provides a hermaphroditic electrical connector. The connector comprises: an insulating body comprising at least one installation wall and a plurality of openings on the installation wall, and a plurality of conductive contactors coupled to the body at the plurality of openings, each comprising at least a pair of a spring portion and a receiving portion, such that at least one of the spring portion and the receiving portion within the pair is configured to detachably connect to a separate electrical connector moving towards an inner surface of the installation wall, while the other of the spring portion and the receiving portion within the pair is configured to detachably connect to a separate electrical connector moving towards an outer surface of the installation wall opposite to the inner surface.

Another embodiment provides a method of manufacturing a hermaphroditic electrical connector. The method comprises: providing an insulating body, the body comprising at least one installation wall and a plurality of openings on the installation wall; providing a plurality of conductive contactors, each comprising at least a pair of a spring portion and a receiving portion; and providing the plurality of the contactors coupled to the body at the plurality of the openings, such that at least one of the spring portion and the receiving portion within the pair is configured to detachably connect to a separate electrical connector moving towards an inner surface of the installation wall, while the other of the spring portion and the receiving portion within the pair is configured to detachably connect to a separate electrical connector moving towards an outer surface of the installation wall opposite to the inner surface.

Yet another embodiment provides a hermaphroditic electrical connector. The connector comprises an insulating body and a plurality of conductive contactors. The body comprises a rectangular base, two installation walls and two connecting walls. The two installation walls have an inner surface and an outer surface opposite to the inner surface, the two installation walls being coupled to two opposing sides of the base and inclined towards the inner surface, a plurality of openings being formed on each of the installation wall. the two connecting walls are coupled to the other two opposing sides of the base and the two installation walls to form a recess on the base. The plurality of conductive contactors distributed uniformly along longitudinal direction of the two installation walls, the number of contactors coupled to one of the two installation walls being the same as the number of contactors coupled to the other of the two installation walls, each being coupled to the body by insert molding at a pair of the plurality of openings and comprising an intermediate plate and two terminals formed at two opposing ends of the intermediate plate for electrically connecting to external devices. The intermediate plate comprises an elastically deformable first spring portion, being configured to extend through one of the pair of the plurality of openings and beyond the inner surface; an elastically deformable second spring portion, being configured to extend in a reverse direction relative to the first spring portion; a first receiving portion; and a second receiving portion, the second receiving portion being accessible through the other of the pair of the plurality of openings, the first receiving portion and the second receiving portion being coplanar with the intermediate plate and stiffer than the first spring portion and the second spring portion; such that the first spring portion and the second receiving portion are configured to detachably connect to a separate electrical connector moving towards the inner surface simultaneously, while the second spring portion and the first receiving portion are configured to detachably connect to a separate electrical connector moving towards the outer surface.

In accordance with embodiments of the subject matter described herein, a hermaphroditic electrical connector having a plurality of conductive contactors can be used to electrically connect to a separate and duplicate hermaphroditic electrical connector. One connector is able to receive another connector from a first side, and also receive another connector from a second side normally opposite to the first side. In addition, when a first connector is fixed onto a first board, a second connector is able to be installed onto the first connector in two different orientations. For example, the second connector can be turned for 180° about a center axis normal to a base of the first connector. This realizes more flexible installation of the connector onto a board despite of orientation prior to forming further electrical connections with external components or devices. Due to the design of an insulating body of the connector, the connector is also able to be self-aligned when the user is about to mate the two connectors with each other, especially when the site to be installed cannot be directly seen or in a dark environment.

It is to be understood that this Summary is provided to introduce a selection of concepts in a simplified form. The concepts are further described below in the Detailed Description. This Summary is not intended to identify key features or essential features of the claimed subject matter, nor is it intended to be used to limit the scope of the claimed subject matter.

DETAILED DESCRIPTION

The subject matter described herein will now be discussed with reference to several example embodiments. It should be understood these embodiments are discussed only for the purpose of enabling those skilled persons in the art to better understand and thus implement the subject matter described herein, rather than suggesting any limitations on the scope of the subject matter.

As used herein, the term "includes" and its variants are to be read as open terms that mean "includes, but is not limited to." The term "or" is to be read as "and/or" unless the context clearly indicates otherwise. The term "based on" is to be read as "based at least in part on." The term "one embodiment" and "an embodiment" are to be read as "at least one embodiment." The term "another embodiment" is to be read as "at least one other embodiment." Other definitions, explicit and implicit, may be included below.

Figure 1:
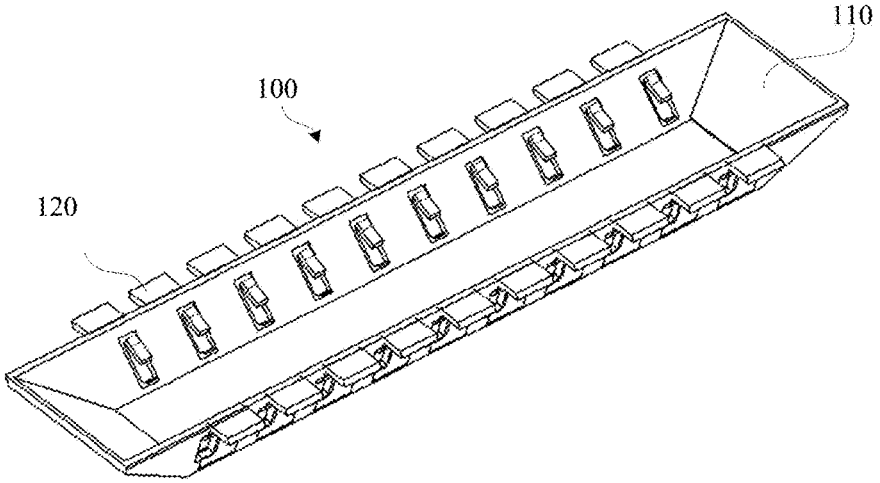
FIG. 1 illustrates a perspective view of a hermaphroditic electrical connector according to one embodiment of the subject matter described herein.
Figure 2:
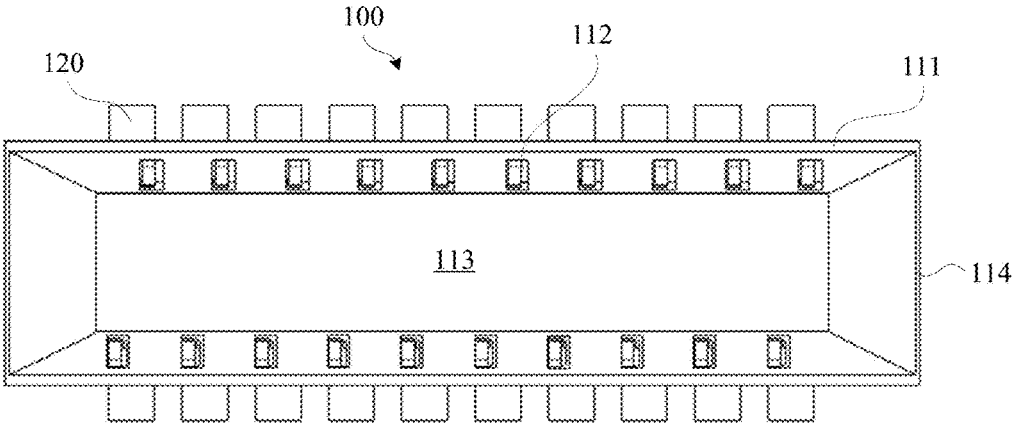
FIG. 2 illustrates a top view of the hermaphroditic electrical connector of FIG. 1.

FIG. 1 and FIG. 2 illustrate an example of a hermaphroditic electrical connector 100 in different views according to one embodiment of the subject matter described herein. It is to be noted that different embodiments of the hermaphroditic electrical connector 100, although constructed in different ways, can all realize the purpose and concept of the subject matter described herein.

With reference to FIG. 1, the hermaphroditic electrical connector 100 includes an insulating body 110 and a plurality of conductive contactors 120 fixed to at least a portion of the insulating body 110. Each of the conductive contactors 120 is provided for forming electrical connection to external components or devices, while being able to form a detachable connection to one of the contactors on another hermaphroditic electrical connector. Term "hermaphroditic" is described herein for a type of electrical connector which can be used on both boards to be connected. In other words, two electrical connectors of this type with same shape, structure and configuration can be used to mate with each other. By using hermaphroditic electrical connectors for forming board-to-board connection, only one kind of machine such as a molding machine is needed for shaping the insulating body, and only one process is required for manufacturing the contactors as well as assembling or inserting the contactors onto the insulating body. As a result, manufacturing cost is reduced significantly while robustness or reliability is not compromised.

With reference to FIG. 2, a plan view is shown for illustrating the insulating body 110 as well as the plurality of conductive contactors 120 according to one example described herein.

In one embodiment, as shown in FIG. 2, the insulating body 110 may include a substantially rectangular base 113, which is essentially flat across the entire surface. However, it is to be noted that the subject matter described herein does not intend to limit the shape of the base 113. In some examples, a base may be shaped with rounded corners, or in a shape other than a rectangle such as pentagon, hexagon and the like. In some cases, a base can be even omitted once the hermaphroditic electrical connector can be steadily fixed onto a board and receive another hermaphroditic electrical connector of the same arrangement. Two hermaphroditic electrical connectors of the same arrangement means that the two connectors share a same size, shape, material, structure, etc. meaning that they are substantially duplicate.

The base 113 includes at least one installation wall 111 for accommodating a number of the conductive contactors 120. In the example as shown in FIGS. 1 and 2, two installation walls 111 can be disposed oppositely at two longitudinal ends of the base 113. Two opposing connecting walls 114 can be disposed at the other two ends of the base 113, each coupling to both of the installation walls 111. The base 113 can be defined to have an inner surface and an outer surface, thus the inner surface is facing upwards as shown in FIGS. 1 and 2. Likewise, each of the two installation walls 111 and the two connecting walls 114 may also have an inner surface continuing the inner surface of the base 113 and an outer surface continuing the outer surface of the base 113. Consequently, a recess is formed by the inner surfaces of the base 113, the installation walls 111, and the connecting walls 114.

In one embodiment, there are provided a number of openings 112 on the insulating body 110, specifically, along the installation wall 111. In the particular example as shown in FIGS. 1 and 2, openings 112 are evenly distributed along the installation wall 111 in a longitudinal direction defined by the longer edge of the rectangular base 113. Each of the openings may have a substantially same height relative to the base 113 and correspond to only one conductive contactor 120. In other words, the plurality of conductive contactors 120 are accommodated or installed onto the installation wall 111 in a manner that they are evenly distributed along the longitudinal direction. In addition, the number of the openings 112 on one of the two installation walls 111 may be equal to the number of the openings 112 on the other one of the two installation walls 111. The particular arrangement of same number of openings 112 on both of the installation walls 111 allows receiving another hermaphroditic electrical connector of the same arrangement in both ways, i.e., by turning 180° about a center axis normal to the base 113, the duplicate hermaphroditic electrical connector can also be connected to the original connector. This realizes more flexible installation of the connector onto a board despite of orientation prior to forming further electrical connections with external components or devices.

It is shown in FIGS. 1 and 2 that each of the two installation walls 111 and the two connecting walls 114 is tilted with certain angles, i.e., inclined from a plane defined by the base 113 towards the respective inner surface of the two installation walls 111 and the two connecting walls 114. As a result, the recess encircled by the two installation walls 111 and the two connecting walls 114 has four chamfered surfaces. In other words, the entire inner surface formed by the four inner surfaces of the two installation walls 111 and the two connecting walls 114 are tapered into the base 113 as seen from above in FIG. 2. It is advantageous to construct the insulating body having a tapered inner surface, because such structure enables a hermaphroditic electrical connector according to the present subject matter described herein and a duplicate hermaphroditic electrical connector being able to be self-aligned when the user is about to mate the two connectors with each other, especially when the site to be installed cannot be directly seen or in a dark environment (it is usually the case when installing a sub-board to a mother board deep inside the case/cabinet of the device).

Figure 3:
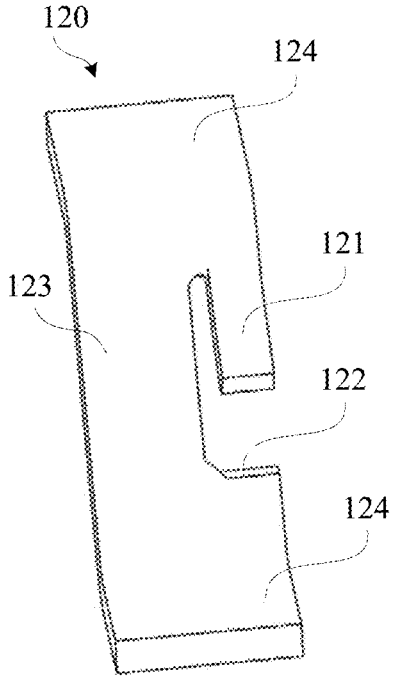
FIG. 3 illustrates a perspective view of a conductive contactor of the hermaphroditic electrical connector of FIG. 1.
Figure 4:
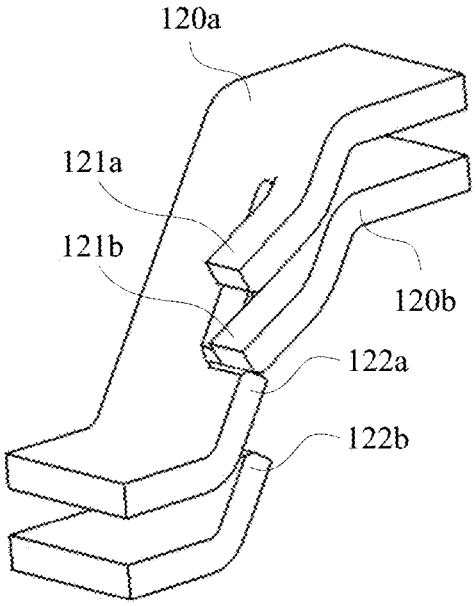
FIG. 4 illustrates an example of two conductive contactors of FIG. 3 being mated with each other when two hermaphroditic electrical connectors of FIG. 1 are connected together.
Figure 5:
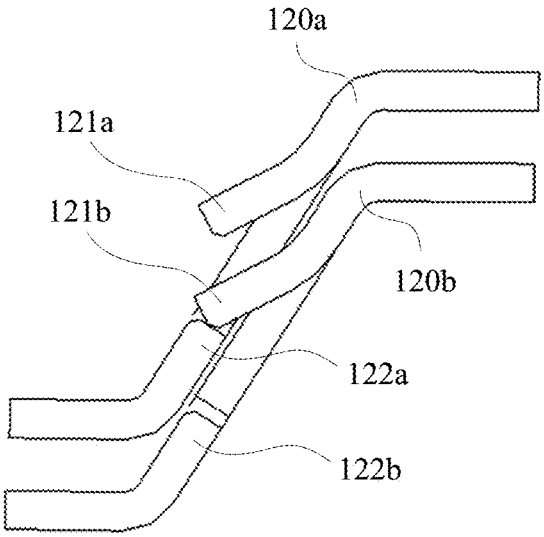
FIG. 5 illustrates another view of the example of two conductive contactors of FIG. 3 being mated with each other when two hermaphroditic electrical connectors of FIG. 1 are connected together.

FIG. 3 illustrates a perspective view of the conductive contactor 120 of the hermaphroditic electrical connector 100 according to the embodiment of the subject matter described herein as shown in FIGS. 1 and 2. FIG. 4 illustrates an example of two conductive contactors 120*a* and 120*b* of FIG. 3 being mated with each other when two hermaphroditic electrical connectors 100 of FIG. 1 are connected together; and FIG. 5 illustrates the side view of the example of FIG. 4. Although the conductive contactors as shown in FIGS. 3 to 5 are of the same size and shape, it is to be noted that this particular example of the contactor can be made and shaped differently.

With reference to FIG. 3, the conductive contactor 120 includes an intermediate plate 123, and a pair of a spring portion 121 and a receiving portion 122 is formed in the intermediate plate 123. In one embodiment, as shown in FIG. 3, the intermediate plate 123 can be substantially flat and the spring portion 121, shaped as a prolonged bar, can be protruding out of the plane defined by the intermediate plate 123. As shown, the receiving portion 122 can be shaped as an edge having rounded end. Also, the end of the spring portion 121 close to the receiving portion 122 can be also shaped to have a rounded end. In one embodiment, the receiving portion 122 may be substantially coplanar with the intermediate plate 123, i.e., does not protrude out of the intermediate plate 123 like the spring portion 121 does. In this particular embodiment, the receiving portion 122 is stiffer than the spring portion 121. As a result, the spring portion 121 can be elastically deformable. On the other hand, the receiving portion 122 is less deformable compared with the spring portion 121 in this particular embodiment as shown by FIG. 3. However, it is to be noted that the receiving portion 122 and the spring portion 121 may also be shaped to have similar stiffness to be both elastically deformable. Although both of the spring portion 121 and the connecting portion 122 are shown to be placed at one edge of the conductive contactor 120, the placement of the spring portion 121 and the connecting portion 122 is not limited, meaning that they can be displaced to the middle of the conductive contactor 120, for example. There can also be two terminals 124 at the two opposing ends continuing the longitudinal ends of the intermediate plate 123 used for forming electrical connection with external components and devices by all sorts of known interconnection means. Therefore, the two terminals 124 may be designed to be exposed out of the insulating body 110 for ease of interconnection.

With reference to FIGS. 4 and 5, an example of an upper conductive contactors 120*a* and a lower conductive contactor 120*b* being mated with each other is depicted. As shown, the two contactors have the same size and shape. When the upper conductive contactors 120*a* and the lower conductive contactor 120*b* are being mutually mated, for example, by putting the upper conductive contactor 120*a* downwards against the lower conductive contact 120*b*, the edge of an upper receiving portion 122*a* of the upper conductive contactor 120*a* will firstly be in contact with the tip of an lower spring portion 121*b* of the lower conductive contactor 120*b*. Then, the lower spring portion 121*b* will be bended downwards due to its elastic property. After the lower spring portion 121*b* is bended to an extent over a predefined threshold, the edge of the upper receiving portion 122*a* is overall lower than the tip of the lower spring portion 121*b*, causing a recovery of the lower spring portion 121*b* back to its rest position in the beginning, so that the two contactors 120*a* and 120*b* can be closely mated with each other.

When the upper conductive contactors 120*a* and the lower conductive contactor 120*b* are being separated from a mated position as described above, certain force is applied on the upper conductive contactor 120*a* intending to initiate a move of the upper conductive contactor 120*a* away from the lower conductive contactor 120*b*. After the applied force exceeding a predefined threshold value, the upper receiving portion 122*a* can squeeze the lower spring portion 121*b* once again downwards, and finally the upper receiving portion 122*a* is detached from the lower spring portion 121*b*. The rounded edge or tip of the lower spring portion 121*b* or the upper receiving portion 122*a* as described above is useful because such design makes the installing process and detaching process as smooth as possible, which enhances the user experience.

By referring back to FIG. 1, in one embodiment, the lower spring portion 121*b* can extend through the opening 112 of its installation wall 111 of the insulating body 110 and beyond the inner surface of the installation wall 111. By this configuration, a hermaphroditic electrical connector is easily aligned and attached to a separate and duplicate hermaphroditic electrical connector.

It is to be understood that "upper" and "lower" are only used to describe the relationship between the components in the figures, instead of limiting their orientation or positioning. For example, in FIGS. 4 and 5, the lower conductive contactor 120*b* can be placed above the upper conductive contactor 120*a* due to their similar structures and shapes. In addition, although the spring portion 121 as shown by FIGS. 3 to 5 is tilted or bended upwards, it can be understood that a spring portion bended downwards may also well function.

When the conductive contactor 120 is to be attached or integrated to the installation wall 111, according to FIGS. 1 and 2 again, in one embodiment, the conductive contactors 120 can be fixedly attached to the outer surfaces of both of the installation walls 111 by any appropriate method. Optionally, the conductive contactors 120 can also be fixedly attached to the inner surfaces of both of the installation walls 111. Another possible arrangement can be that the conductive contactors 120 are coupled to the insulating body 110 by insert molding, meaning that each of the conductive contactors 120 is inserted into the installation walls 111 with only the two terminals 124, the spring portion 121 and the receiving portion 122 being exposed. The present subject matter described herein does not intend to limit the way how the conductive contactor 120 is coupled to the installation wall 111.

In one embodiment, the conductive contactor 120 can be made of a conductive material, such as copper, which has an excellent conductivity and toughness.

In a further embodiment, the conductive contactor 120 can be plated with gold, which provides great signal transmission properties, mating durability, and excellent oxidation resistance against polluted environment. Additionally, the conductive contactor 120 can also be plated with nickel beneath the gold layer acting as a diffusion barrier. Alternatively, silver can be plated for applications where low intermodulation is required, and chrome can be plated for connectors used in harsh environment such as for military applications.

FIGS. 6 to 14 illustrate an example of a hermaphroditic electrical connector 200 in different views according to another embodiment of the subject matter described herein.

Figure 6:
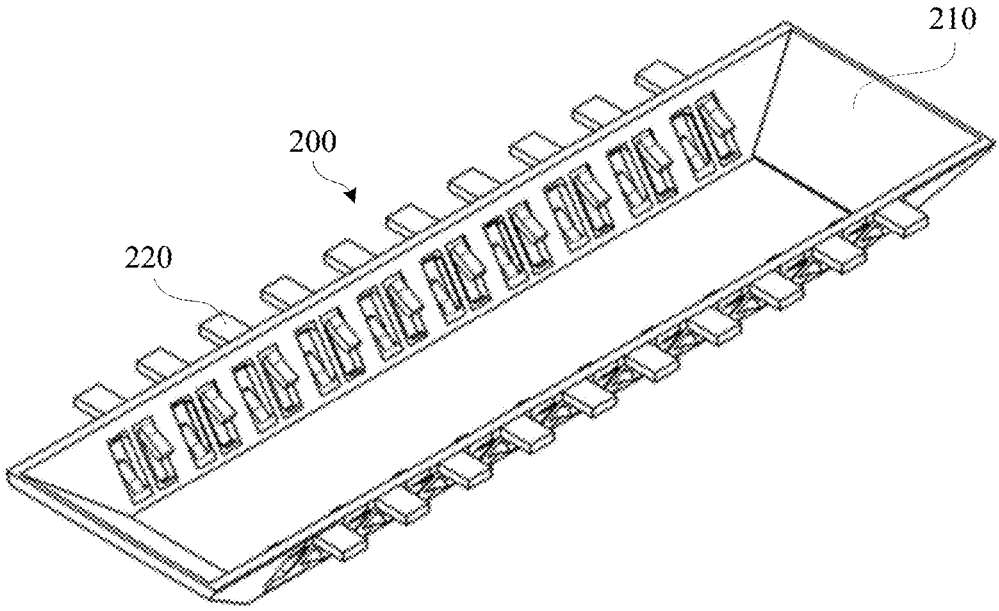
FIG. 6 illustrates a perspective view of the hermaphroditic electrical connector according to another embodiment of the subject matter described herein.
Figure 7:
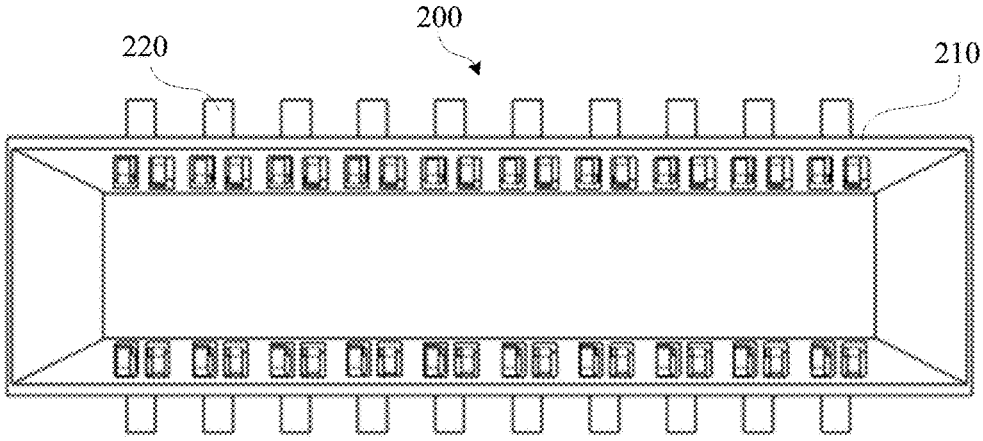
FIG. 7 illustrates a top view of the hermaphroditic electrical connector of FIG. 6.
Figure 8:
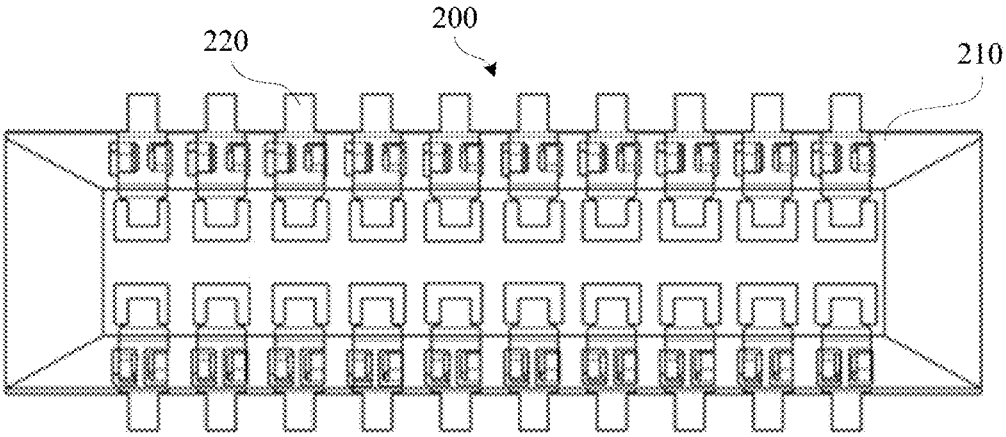
FIG. 8 illustrates a bottom view of the hermaphroditic electrical connector of FIG. 6.

With reference to FIGS. 6 to 8, the hermaphroditic electrical connector 200 includes an insulating body 210 and a plurality of conductive contactors 220 fixed to at least a portion of the insulating body 210. Each of the conductive contactors 220 is provided for forming electrical connection to external components or devices, while being able to form a detachable connection to one of the contactors on another hermaphroditic electrical connector. In this particular embodiment, each of the conductive contactors is connected to another duplicate conductive contactor by forming two contact points.

Figure 9:
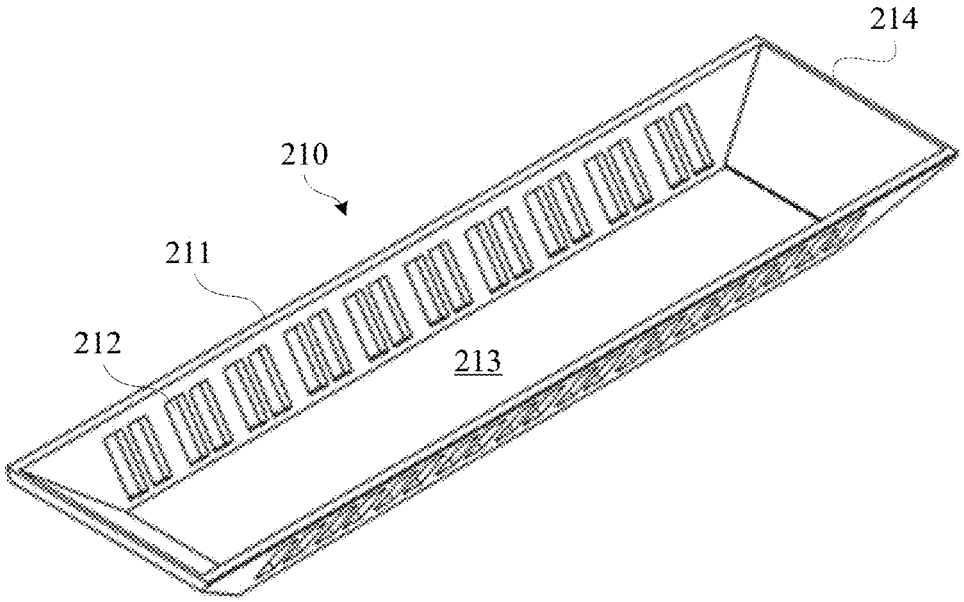
FIG. 9 illustrates a perspective view of an insulating body of the hermaphroditic electrical connector of FIG. 6.

With reference to FIG. 9, a perspective view is shown for illustrating the insulating body 210 according to one example described herein.

In one embodiment, as shown in FIG. 9, the insulating body 210 may include a substantially rectangular base 213, which is essentially flat across the entire surface. As described above, the base may be shaped with differently, and the present subject matter described herein does not intend to limit the configuration of the base.

The base 213 includes at least one installation wall 211 for accommodating a number of the conductive contactors 220. In the example as shown in FIGS. 6 to 9, two installation walls 211 can be disposed oppositely at two longitudinal ends of the base 213. Two opposing connecting walls 214 can be disposed at the other two ends of the base 213, each coupling to both of the installation walls 211. The base 213 can be defined to have an inner surface and an outer surface, thus the inner surface is facing upwards as shown. Likewise, each of the two installation walls 211 and the two connecting walls 214 may also have an inner surface continuing the inner surface of the base 213 and an outer surface continuing the outer surface of the base 213. Consequently, a recess is formed by the inner surfaces of the base 213, the installation walls 211, and the connecting walls 214.

In one embodiment, there are provided a number of openings 212 on the insulating body 210, specifically, along the installation wall 211. As can be clearly observed in FIG. 9, pairs of openings 212 are provided each (i.e., twin openings) for receiving one single conductive contactor 220, and a plurality of the pairs are evenly distributed along the installation wall 211 in a longitudinal direction defined by the longer edge of the rectangular base 213. Each of the openings may have a substantially same height relative to the base 213. In other words, the plurality of conductive contactors 220 are accommodated or installed onto the installation wall 211 in a manner that they are evenly distributed along the longitudinal direction, and each of the conductive contactors 220 corresponds to a pair of the openings 212. In addition, the number of the openings 212 on one of the two installation walls 211 may be equal to the number of the openings 212 on the other one of the two installation walls 211. The particular arrangement of same number of openings 212 on both of the installation walls 211 allows receiving another hermaphroditic electrical connector of the same arrangement in both ways, i.e., by turning 180° about a center axis normal to the base 213, the duplicate hermaphroditic electrical connector can also be connected to the original connector. This realizes more flexible installation of the connector onto a board despite of orientation prior to forming further electrical connections with external components or devices.

It is shown in FIGS. 6 to 9 that each of the two installation walls 211 and the two connecting walls 214 is tilted with certain angles, i.e., inclined from a plane defined by the base 213 towards the respective inner surface of the two installation walls 211 and the two connecting walls 214. As a result, the recess encircled by the two installation walls 211 and the two connecting walls 214 has four chamfered surfaces. In other words, the entire inner surface formed by the four inner surfaces of the two installation walls 211 and the two connecting walls 214 are tapered into the base 213 as seen from above in FIG. 9. As described above, it is advantageous to construct the insulating body having a tapered inner surface, because such structure enables a hermaphroditic electrical connector according to the present subject matter described herein and a duplicate hermaphroditic electrical connector being able to be self-aligned when the user is about to mate the two connectors with each other.

Figure 10:
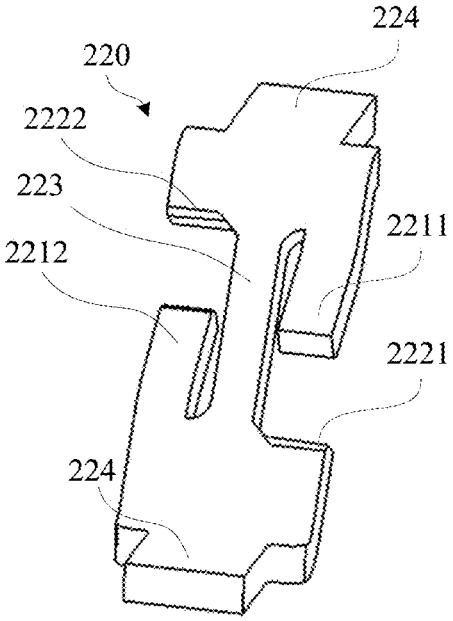
FIG. 10 illustrates a perspective view of a conductive contactor of the hermaphroditic electrical connector of FIG. 6.
Figure 11:
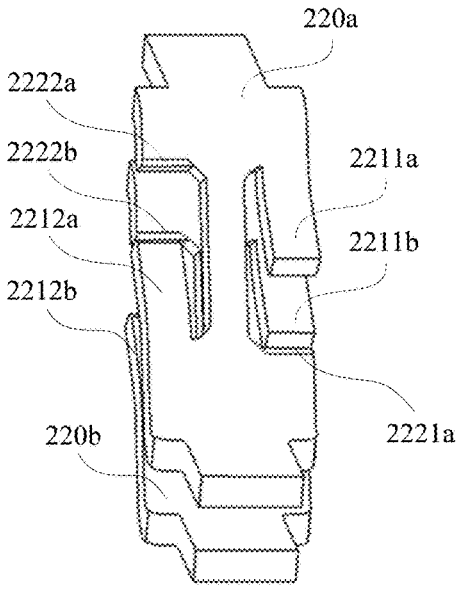
FIG. 11 illustrates an example of two conductive contactor of FIG. 10 being mated with each other when two hermaphroditic electrical connectors of FIG. 6 are connected together.

FIG. 10 illustrates a perspective view of the conductive contactor 220 of the hermaphroditic electrical connector 200 according to the embodiment of the subject matter described herein as shown in FIGS. 6 to 9. FIG. 11 illustrates an example of two conductive contactors 220*a* and 220*b* of FIG. 10 being mated with each other when two hermaphroditic electrical connectors 200 of FIG. 10 are connected together. Although the conductive contactors as shown in FIGS. 10 and 11 are of the same size and shape, it is to be noted that this particular example of the contactor can be made and shaped differently.

With reference to FIG. 10, the conductive contactor 220 includes an intermediate plate 223, and two pairs of a spring portion 2211, 2212 and a receiving portion 2221, 2222 are formed in the intermediate plate 223. In one embodiment, as shown in FIG. 10, the intermediate plate 223 can be substantially flat and a first spring portion 2211 and a second spring portion 2212, both shaped as a prolonged bar, can be protruding out of the plane defined by the intermediate plate 223. As shown, the extension direction of the first spring portion 2211 can be opposite to the extension direction of the second spring portion 2212. A first receiving portion 2221 and a second receiving portion 2222 can be shaped as an edge having rounded end. Also, the end of the first and second spring portions 2211, 2212 respectively close to the first and second receiving portions 2221, 2222 can be also shaped to have a rounded end. In one embodiment, the first and second receiving portions 2221, 2222 may be substantially coplanar with the intermediate plate 223, i.e., does not protrude out of the intermediate plate 223 like the first and second spring portions 2211, 2212 do. In this particular embodiment, each of the first and second receiving portions 2221, 2222 is stiffer than its corresponding spring portion. As a result, the first and second spring portions 2211, 2212 can be elastically deformable. On the other hand, the first and second receiving portions 2221, 2222 are less deformable compared with the first and second spring portions 2211, 2212 in this particular embodiment as shown by FIG. 10. However, it is to be noted that the first and second receiving portions 2221, 2222 and the first and second spring portions 2211, 2212 may also be shaped to have similar stiffness to be both elastically deformable. Optionally, the first and second spring portions 2211, 2212 can be designed to have same dimensions, while the first and second connecting portions 2221, 2222 can also be designed to have same dimension. Although both pairs of the spring portions 2211, 2212 and the connecting portions 2221, 2222 are shown to be placed at two edges of the conductive contactor 220, the placement of the spring portions 2211, 2212 and the connecting portions 2221, 2222 is not limited. There can also be two terminals 224 at the two opposing ends continuing the longitudinal ends of the intermediate plate 223 used for forming electrical connection with external components and devices by all sorts of known interconnection means. Therefore, the two terminals 224 may be designed to be exposed out of the insulating body 210 for ease of interconnection.

With reference to FIG. 11, an example of an upper conductive contactors 220*a* and a lower conductive contactor 220*b* being mated with each other is depicted. As shown, the two contactors have the same size and shape. When the upper conductive contactors 220*a* and the lower conductive contactor 220*b* are being mutually mated, for example, by putting the upper conductive contactor 220*a* downwards against the lower conductive contact 220*b*, the edge of an upper first receiving portion 2221*a* of the upper conductive contactor 220*a* will firstly be in contact with the tip of a lower first spring portion 2211*b* of the lower conductive contactor 220*b*, and simultaneously, the edge of an upper second spring portion 2212*a* of the upper conductive contactor 220*a* is in contact with the tip of a lower second receiving portion 2222*b* of the lower conductive contactor 220*b*. Then, the lower first spring portion 2211*b* will be bended downwards and the upper second spring portion 2212*a* will be bended upwards due to their elastic properties. After the lower first spring portion 2211*b* and the upper second spring portion 2212*a* are bended to an extent over a predefined threshold, the edge of the upper first receiving portion 2221*a* is overall lower than the tip of the lower first spring portion 2211*b* and the tip of the upper second spring portion 2212*a* is lower than the edge of the lower second receiving portion 2222*b*, causing a recovery of the lower first spring portion 2211*b* and the upper second spring portion 2212*a* back to their rest positions in the beginning, so that the two contactors 220*a* and 220*b* can be closely mated with each other.

When the upper conductive contactors 220*a* and the lower conductive contactor 220*b* are being separated from a mated position as described above, certain force is applied on the upper conductive contactor 220*a* intending to initiate a move of the upper conductive contactor 220*a* away from the lower conductive contactor 220*b*. After the applied force exceeding a predefined threshold value, the upper first receiving portion 2221*a* can squeeze the lower first spring portion 2211*b* once again downwards and the lower second receiving portion 2222*b* can squeeze the upper second spring portion 2212*a* once again upwards, and finally the upper first receiving portion 2221*a* and the upper second spring portion 2212*a* are respectively detached from the lower first spring portion 2211*b* and the lower second receiving portion 2222*b*. As described above, the rounded edge or tip of the spring portions or the receiving portions as described above is useful because such design makes the installing process and detaching process as smooth as possible, which enhances the user experience.

It is to be understood that "upper" and "lower" are only used to describe the relationship between the components in the figures, instead of limiting their orientation or positioning. For example, in FIG. 11, the lower conductive contactor 220*b* can be placed above the upper conductive contactor 220*a* due to their similar structures and shapes.

When the conductive contactor 220 is to be attached or integrated to the installation wall 211, according to FIGS. 6 to 9 again, in one embodiment, the conductive contactors 220 can be fixedly attached to the outer surfaces of both of the installation walls 211 by any appropriate method. Optionally, the conductive contactors 220 can also be fixedly attached to the inner surfaces of both of the installation walls 211. Another possible arrangement can be that the conductive contactors 220 are coupled to the insulating body 210 by insert molding, meaning that each of the conductive contactors 220 is inserted into the installation walls 211 with only the two terminals 224, the spring portion 221 and the receiving portion 222 being exposed. The present subject matter described herein does not intend to limit the way how the conductive contactor 220 is coupled to the installation wall 211.

In one embodiment, the conductive contactor 220 can be made of a conductive material, such as copper, which has an excellent conductivity and toughness.

In a further embodiment, as described above, the conductive contactor 220 can be plated with at least one of gold, nickel, silver, and chrome for various applications.

Figure 12:
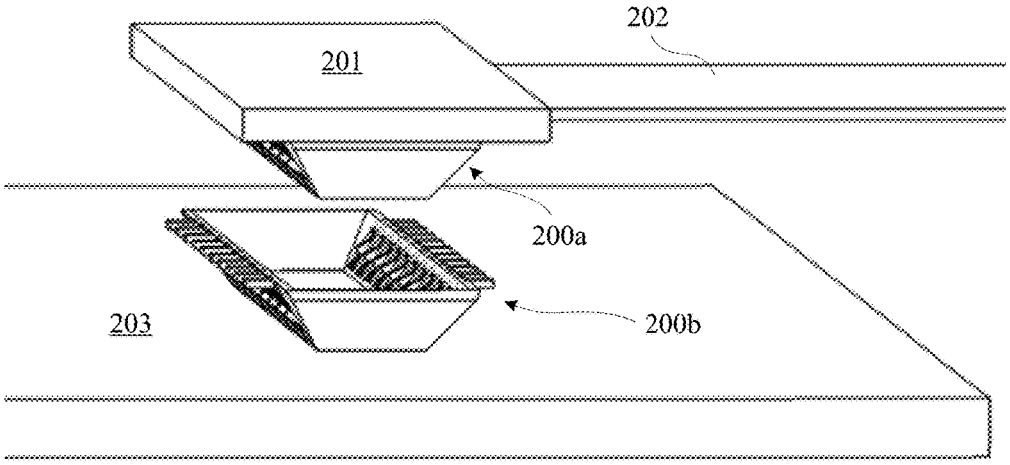
FIG. 12 illustrates an example of two hermaphroditic electrical connectors of FIG. 6 being connected together for forming board-to-board connection.

FIG. 12 illustrates an example of an upper hermaphroditic electrical connector 200*a* and a lower hermaphroditic electrical connector 200*b* as shown in FIG. 6 being connected together for forming board-to-board connection. In one embodiment, the upper hermaphroditic electrical connector 200*a* can be fixed onto a stiffener 201 for forming electrical connection between the conductive contactors 220*a* and the board, and the stiffener 201 is coupled with a flexible printed circuit (FPC) 202 for connecting an external component or device. Meanwhile, the lower hermaphroditic electrical connector 200*b* can be fixed onto a printed circuit board (PCB) 203 for forming its contacts. When the two connectors are attached to each other in a mated position, signal or power can be transferred from the PCB 203 to the external component or device via the FPC 202, or vice versa. For example, a common example can be a desktop computer system, in which a hard disk drive may be connected to a mother board via a FPC, a stiffener, an upper hermaphroditic electrical connector on the stiffener, and a lower hermaphroditic electrical connector on the mother board.

Figure 13:
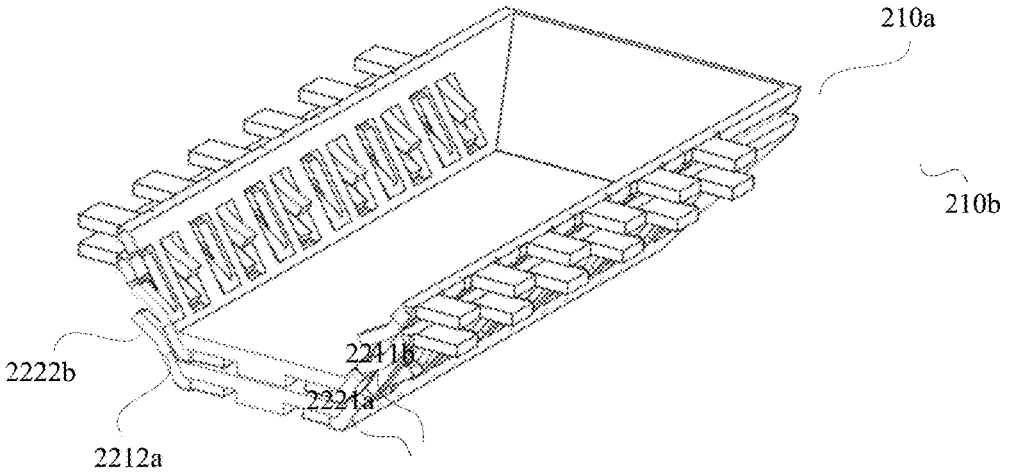
FIG. 13 illustrates a sectional view of the two hermaphroditic electrical connectors of FIG. 12 being connected together, showing mated contactors in the cross section.
Figure 14:
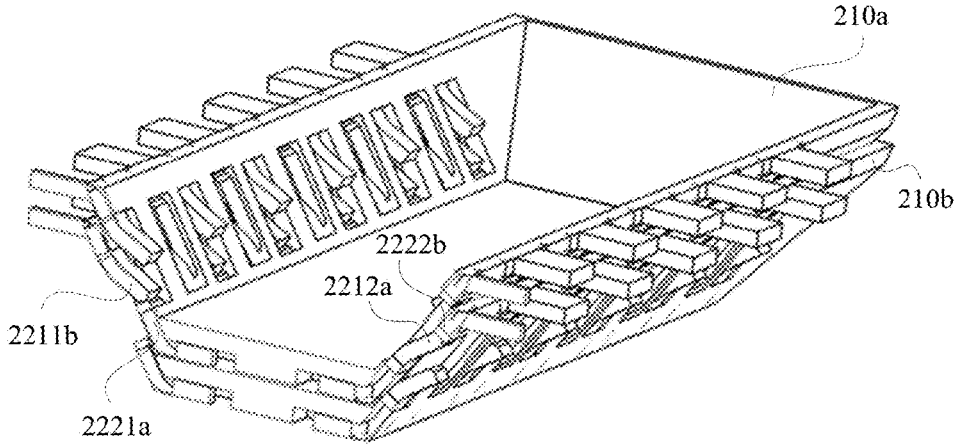
FIG. 14 illustrates another sectional view of the two hermaphroditic electrical connectors of FIG. 12 being connected together, showing mated contactors in the cross section.

With reference to FIGS. 13 and 14, two different sectional views of the two hermaphroditic electrical connectors 210*a*, 210*b* of FIG. 12 can be connected together, showing mated contactors in the cross section. In the sectional planes of FIGS. 13 and 14, it is shown that the upper second spring portion 2212*a* is detachably mated with the lower second receiving portion 2222*b*, while the upper first receiving portion 2221*a* is detachably mated with the lower first spring portion 2211*b*. By referring to FIGS. 13 and 14, it can be observed that the first spring portion can extend through an opening and beyond the inner surface of the installation wall in order to form detachable connection with the first receiving portion of a duplicate hermaphroditic conductive connector installed from above. Also, the second spring portion can extend in a reverse direction relative to the first spring portion in order to form detachable connection with the second receiving portion of a duplicate hermaphroditic conductive connector installed from below though an opening of the duplicate hermaphroditic conductive connector.

Figure 15:
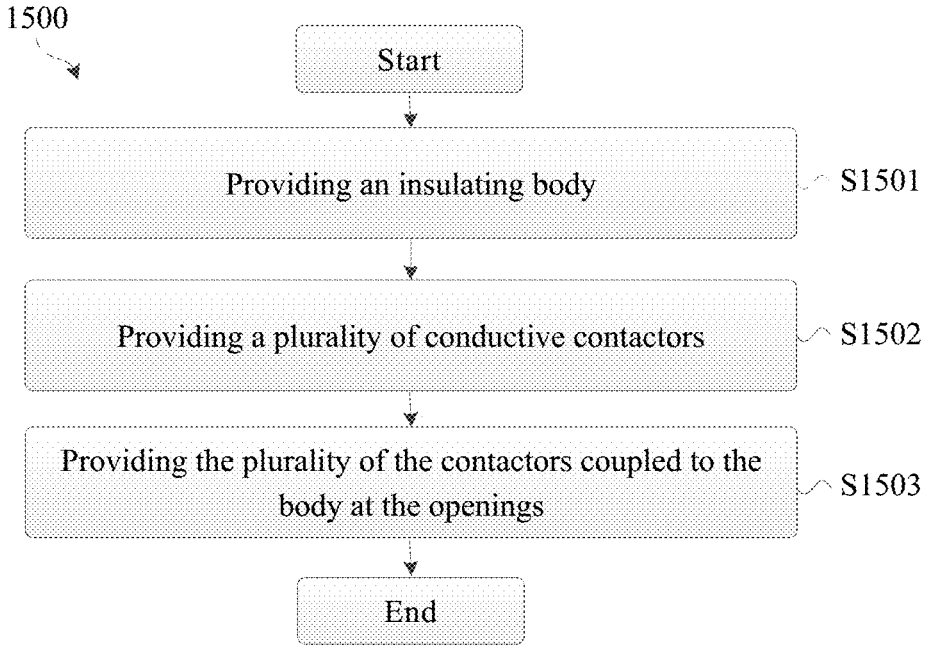
FIG. 15 illustrates a block diagram of a method of manufacturing the hermaphroditic electrical connector in accordance with embodiments of the subject matter described herein.

With reference to FIG. 15, it illustrates a block diagram of a method 1500 of manufacturing the hermaphroditic electrical connector 100, 200 in accordance with embodiments of the subject matter described herein. At step S1501, an insulating body can be provided, where the body includes at least one installation wall and a plurality of openings on the installation wall. At step S1502, a plurality of conductive contactors can be provided, each including at least a pair of a spring portion and a receiving portion. At step S1503, the plurality of the contactors coupled to the body at the plurality of the openings can be provided, such that at least one of the spring portion and the receiving portion within the pair is configured to detachably connect to a separate electrical connector moving towards an inner surface of the installation wall, while the other of the spring portion and the receiving portion within the pair may be detachably connected to a separate electrical connector moving towards an outer surface of the installation wall opposite to the inner surface.

The step S1501 can also include providing a rectangular base; providing two installation walls coupled to two opposing sides of the base and inclined towards the inner surface; and providing two connecting walls coupled to the other two opposing sides of the base and the two installation walls to form a recess on the base.

The step S1502 can also include providing at least the spring portion being elastically deformable, and providing the receiving portion being mechanically stiffer than the spring portion. Optionally, the step S1502 can include providing two pairs of the spring portion and the receiving portion, one of the pairs comprising a first spring portion and a first receiving portion while the other of the pairs comprising a second spring portion and a second receiving portion, such that the first spring portion is configured to extend through the opening and beyond the inner surface. Still optionally, the step S1502 can include providing an intermediate plate forming the two pairs of the spring portion and the receiving portion, such that the second spring portion is configured to extend in a reverse direction relative to the first spring portion. Further optionally, the step S1502 can include providing the two receiving portions being coplanar with the intermediate plate. Also, the step S1502 can include providing two terminals formed at two opposing ends of the intermediate plate for electrically connecting to external devices.

The step S1503 can also include providing each of the plurality of contactors corresponding to two openings, such that one of the two openings is configured to receive the first spring portion, while the other of the two openings is accessible to the second receiving portion. Optionally, the contactors are coupled to the body at the openings by insert molding.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A hermaphroditic electrical connector, comprising:

an insulating body comprising at least two installation walls, each installation wall comprising an inner surface and an outer surface, and a plurality of openings on the installation walls, and a plurality of conductive contactors, each of the plurality of conductive contactors having a same shape, coupled to the insulating body at the plurality of openings, each comprising at least a pair of a spring portion and a receiving portion, such that the plurality of conductive contactors are arranged in pairs, each pair comprising a first and second spring portion and a first and second receiving portion, the first spring portion and the second receiving portion being configured to detachably connect to a separate electrical connector moving towards the inner surface simultaneously, while the second spring portion and the first receiving portion are configured to detachably connect to a separate electrical connector moving towards the outer surface.

2. The hermaphroditic electrical connector according to claim 1, wherein the first receiving portion is mechanically stiffer than the second spring portion and at least the second spring portion is elastically deformable.

3. The hermaphroditic electrical connector according to claim 2, wherein the first spring portion is configured to extend through the opening and beyond the inner surface.

4. The hermaphroditic electrical connector according to claim 3, wherein each of the plurality of conductive contactors comprises an intermediate plate forming two pairs of the spring portion and the receiving portion, such that the second spring portion is configured to extend in a reverse direction relative to the first spring portion.

5. The hermaphroditic electrical connector according to claim 4, wherein the two receiving portions are coplanar with the intermediate plate.

6. The hermaphroditic electrical connector according to claim 5, wherein each of the plurality of conductive contactors comprises two terminals formed at two opposing ends of the intermediate plate for electrically connecting to external devices.

7. The hermaphroditic electrical connector according to claim 6, wherein each of the plurality of conductive contactors is plated with at least one of gold, nickel, silver, and chrome.

8. The hermaphroditic electrical connector according to claim 1, wherein the insulating body comprises a rectangular base, two installation walls coupled to two opposing sides of the rectangular base and inclined towards the inner surface, and two connecting walls coupled to another two opposing sides of the rectangular base and the two installation walls to form a recess on the rectangular base.

9. The hermaphroditic electrical connector according to claim 3, wherein each of the plurality of conductive contactors corresponds to two openings, such that one of the two openings is configured to receive the first spring portion, while another of the two openings is accessible to the second receiving portion.

10. The hermaphroditic electrical connector according to claim 8, wherein a number of conductive contactors coupled to one of the two installation walls equals the number of conductive contactors coupled to the another of the two installation walls.

11. A method of manufacturing a hermaphroditic electrical connector, comprising:

providing an insulating body, the insulating body being symmetric about a longitudinal axis, the insulating body comprising at least two installation walls, each installation wall comprising an inner surface and an outer surface, and a plurality of openings on the installation walls;

providing a plurality of conductive contactors, each comprising at least a pair of a spring portion and a receiving portion; and providing the plurality of conductive contactors coupled to the insulating body at the plurality of the openings, such that the plurality of conductive contactors are arranged in pairs, each pair comprising a first and second spring portion and a first and second receiving portion, the first spring portion and the second receiving portion being configured to detachably connect to a separate electrical connector moving towards the inner surface simultaneously, while the second spring portion and the first receiving portion are configured to detachably connect to a separate electrical connector moving towards the outer surface.

12. The method according to claim 11, wherein providing the plurality of conductive contactors comprises:

providing at least the first spring portion being elastically deformable, and providing the second receiving portion being mechanically stiffer than the first spring portion.

13. The method according to claim 12, wherein providing the plurality of conductive contactors comprises:

the first spring portion being configured to extend through the opening and beyond the inner surface.

14. The method according to claim 13, wherein providing the plurality of conductive contactors comprises:

providing an intermediate plate forming two pairs of the spring portion and the receiving portion, such that the second spring portion is configured to extend in a reverse direction relative to the first spring portion.

15. The method according to claim 14, wherein providing the plurality of conductive contactors comprises:

providing the two receiving portions being coplanar with the intermediate plate.

16. The method according to claim 15, wherein providing the plurality of conductive contactors comprises:

providing two terminals formed at two opposing ends of the intermediate plate for electrically connecting to external devices.

17. The method according to claim 11, wherein providing the insulating body comprises:

providing a rectangular base;

providing two installation walls coupled to two opposing sides of the rectangular base and inclined towards the inner surface; and providing two connecting walls coupled to another two opposing sides of the rectangular base and the two installation walls to form a recess on the rectangular base.

18. The method according to claim 13, wherein providing the insulating body comprises:

providing each of the plurality of conductive contactors corresponding to two openings, such that one of the two openings is configured to receive the first spring portion, while another of the two openings is accessible to the second receiving portion.

19. The method according to claim 18, wherein the plurality of conductive contactors are coupled to the insulating body at the plurality of the openings by insert molding.

20. A hermaphroditic electrical connector, comprising:

an insulating body, comprising a rectangular base;

two installation walls having an inner surface and an outer surface opposite to the inner surface, the two installation walls being coupled to two opposing sides of the rectangular base and inclined towards the inner surface, a plurality of openings being formed on each of the installation wall; and two connecting walls coupled to another two opposing sides of the rectangular base and the two installation walls to form a recess on the rectangular base; and a plurality of conductive contactors distributed uniformly along longitudinal direction of the two installation walls, a number of conductive contactors coupled to one of the two installation walls equaling the number of conductive contactors coupled to another of the two installation walls, each being coupled to the insulating body by insert molding at a pair of the plurality of openings and comprising an intermediate plate and two terminals formed at two opposing ends of the intermediate plate for electrically connecting to external devices, the intermediate plate comprises:

an elastically deformable first spring portion, being configured to extend through one of the pair of the plurality of openings and beyond the inner surface;

an elastically deformable second spring portion, being configured to extend in a reverse direction relative to the elastically deformable first spring portion;

a first receiving portion; and a second receiving portion, the second receiving portion being accessible through another of the pair of the plurality of openings, the first receiving portion and the second receiving portion being coplanar with the intermediate plate and stiffer than the elastically deformable first spring portion and the elastically deformable second spring portion; such that the elastically deformable first spring portion and the second receiving portion are configured to detachably connect to a separate electrical connector moving towards the inner surface simultaneously, while the elastically deformable second spring portion and the first receiving portion are configured to detachably connect to a separate electrical connector moving towards the outer surface.

* * * * *